US005483897A

United States Patent [19]

Doherty

[11] Patent Number: 5,483,897

[45] Date of Patent: Jan. 16, 1996

[54] TRACK AND RAIL-FORM SLIDER COMBINATIONS

[75] Inventor: Darrell Doherty, Edmonton, Canada

[73] Assignee: Golden Rod Welding Ltd., Edmonton, Canada

[21] Appl. No.: 382,974

[22] Filed: Feb. 3, 1995

[30] Foreign Application Priority Data

Apr. 19, 1994 [CA] Canada ..... 2121651

[51] Int. Cl.[6] ..... A63G 21/00

[52] U.S. Cl. ..... 104/135

[58] Field of Search ..... 104/135, 134, 104/117, 15, 126, 137; 105/150; 212/77, 74; 198/836.1, 465.4

[56] References Cited

U.S. PATENT DOCUMENTS 3,595,377 7/1971 McCoy ..... 104/135

4,042,128 8/1977 Shrader ..... 104/135

5,237,143 8/1993 Scheuchzer ..... 104/15

5,360,102 11/1994 Schoning ..... 198/836.1

*Primary Examiner*—Mark T. Le

*Attorney, Agent, or Firm*—Anthony R. Lambert

[57] ABSTRACT

A track and rail-form slider combination includes a rail-form slider having a top surface, a bottom surface, and sides extending between the top surface and the bottom surface. Four corners are formed where the top surface meets the sides and the bottom surface meets the sides. A track is provided which includes a plurality of roller supports. At least four rollers are secured to each roller support. Each roller engages the rail-form slider solely at one of the corners.

10 Claims, 2 Drawing Sheets

TRACK AND RAIL-FORM SLIDER COMBINATIONS

The present invention relates to a track and rail-form slider combination.

BACKGROUND OF THE INVENTION

A variety of safety and lifting systems anchor lines or equipment overhead. When the job requires movement within a defined area, some means must be provided to move the anchoring point. One manner of doing so involves the use of an overhead track system in which is positioned a slider to which the lines or equipment are anchored.

There are a variety of different configurations of track and slider combinations. One that most closely resembles the present invention uses a rail-form slider which is supported by track members with rollers that engage the top surface and the bottom surface of the rail-form slider. One problem experienced with rail-form sliders is that dirt and dust tends to accumulate on the top surface of the rail-form slider. The build up of dirt and dust impedes the operation of the slider. Another problem relates to the force vectors exerted upon the slider. In most applications the force exerted upon the slider will have a lateral component. If this lateral component is too great a twisting of the rail-form slider occurs which can lead to the slider binding.

SUMMARY OF THE INVENTION

What is required is a track and rail-form slider combination that is less susceptible to the above described problems.

According to the present invention there is provided a track and rail-form slider combination which is comprised of a rail-form slider having a top surface, a bottom surface, and sides extending between the top surface and the bottom surface. Four corners are formed where the top surface meets the sides and the bottom surface meets the sides. A track is provided which includes a plurality of roller supports. At least four rollers are secured to each roller support. Each roller engages the rail-form slider solely at one of the corners.

Although beneficial results may be obtained through the use of the track and rail-form slider combination, described above, for ease of assembly it is preferred that the rollers be arranged in pairs with each pair mounted on a roller assembly bar in a generally "V" shaped configuration. The rollers should be disposed at an angle of between 30 degrees and 60 degrees relative to one of the top surface and the bottom surface of the rail-form slider. It is preferred that each roller be disposed at an angle of 45 degrees relative to one of the top surface and the bottom surface of the rail-form slider.

Although beneficial results may be obtained through the use of the track and rail-form slider combination, as described above, greater stability can be obtained when each roller assembly bar has two pairs of rollers axially spaced along the roller assembly bar.

Although beneficial results may be obtained through the use of the track and rail-form slider combination, as described above, another problem relates to the fabrication of the rail-form slides. In order to have a rail-form slider that is long enough, it is common for a number of rail sections to be secured together, with fasteners, by welding or other means. If care is not taken in the preparation of the joints between these sections, imperfections and gaps at the joints between rail sections impedes the operation of the slider.

Even more beneficial results may, therefore, be obtained when biasing means are disposed between one of the roller assembly bars and the roller supports. The biasing means biases the roller assembly bar into engagement with the rail-form slider such that the roller assembly bar moves in and out to accommodate imperfections in the rail-form slider.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
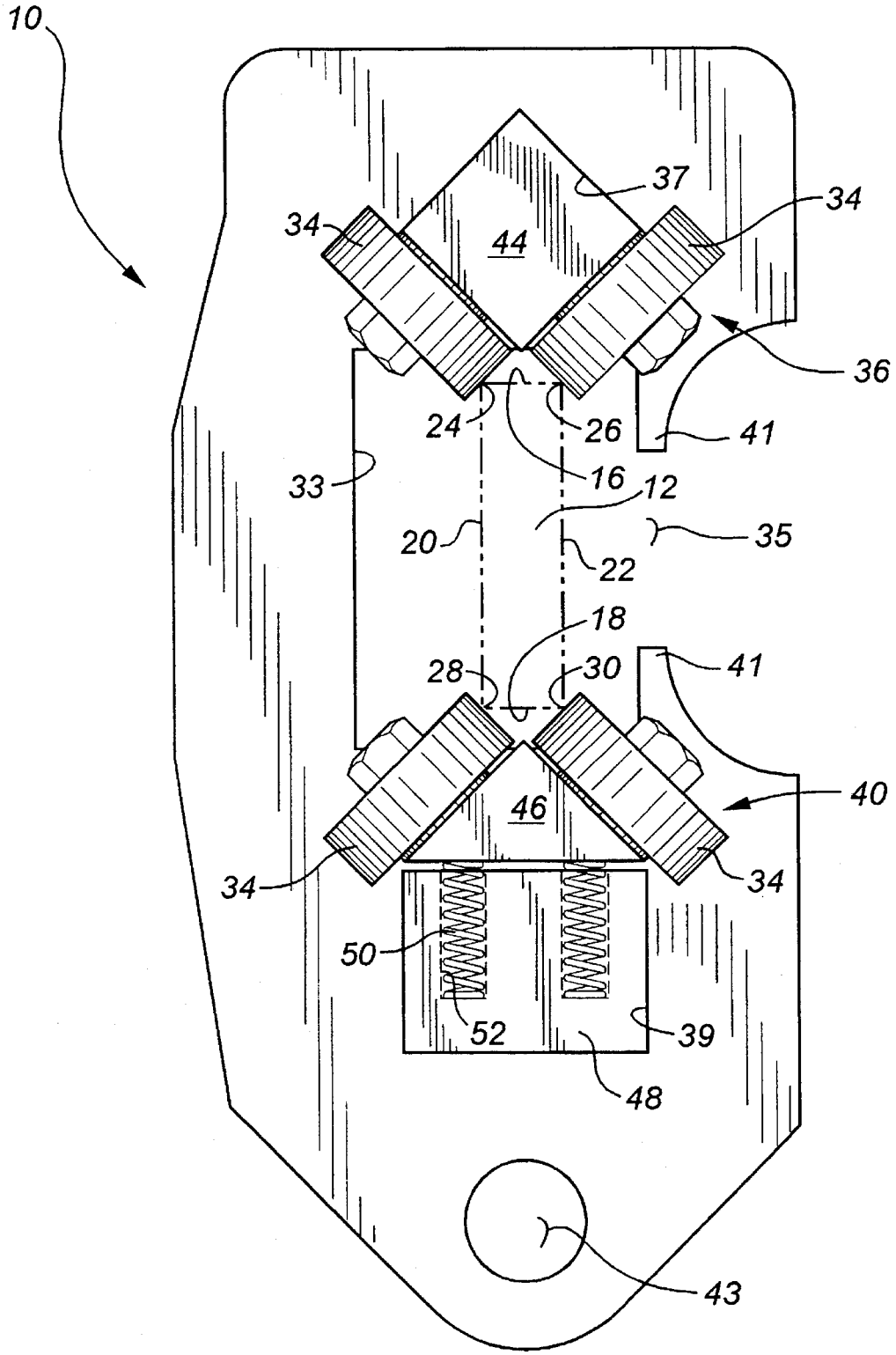
FIG. 1 is an end elevation view of a track and rail-form slider combination constructed in accordance with the teachings of the present invention.

The preferred embodiment, a track and rail-form slider combination generally identified by reference numeral 10, will now be described with reference to FIGS. 1 and 2.

Figure 2:
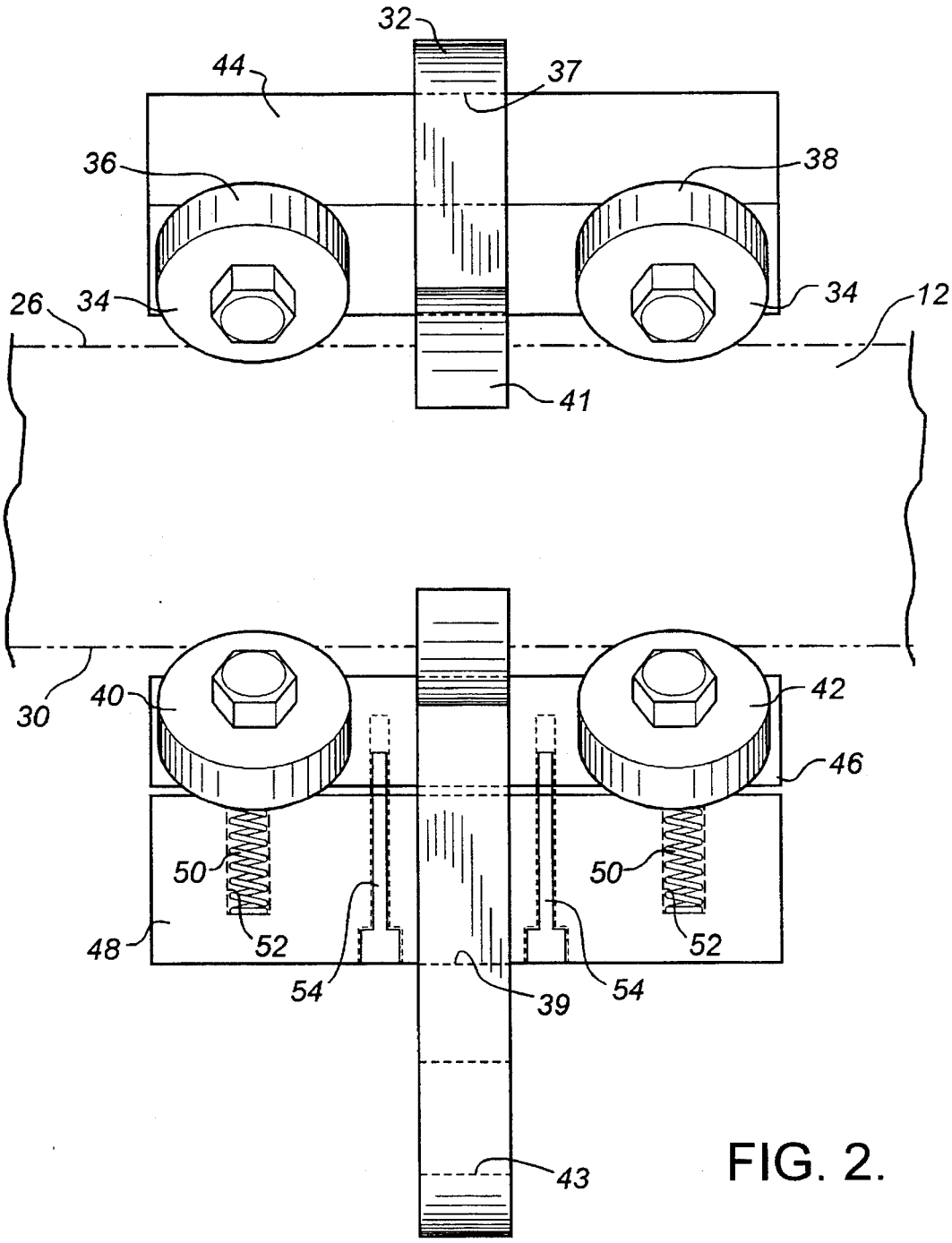
FIG. 2 is a side elevation view of the track and rail-form slider combination illustrated in FIG. 1.

Referring to FIG. 1, the primary components of track and rail-form slider combination 10 are a rail-form slider 12 in combination with a track 14. Rail-form slider 12 has a top surface 16, a bottom surface 18, and sides 20 and 22 extending between top surface 16 and bottom surface 18. Rail-form slider 12 has four corners 24, 26, 28, and 30. Corners 24 and 26 are formed where top surface 16 meets sides 20 and 22, respectively. Corners 28 and 30 are formed where bottom surface 18 meets sides 20 and 22, respectively. Track 14 includes a plurality of roller supports 32, only one of which is illustrated. Roller support 32 is fabricated out of plate steel. It has an generally rectangular central cavity 33, access to which is provided through a side opening 35. Adjoining central cavity 33 are an upper aperture 37 and a lower aperture 39, the purpose of which will hereinafter be further explained. Tabs 41 inwardly to partially obstruct side opening 35. A mounting hole 43 is provided to facilitate the mounting of roller support 32. Eight rollers 34 are provided arranged in four pairs 36, 38, 40, 42. Pair of rollers 36, 38, 40 and 42 are mounted on roller assembly bars 44 and 46 in a generally "V" shaped configuration. Upper roller assembly bar 44 has pairs of rollers 36 and 38 axially spaced along its length. Lower roller assembly bar 46 has pairs of rollers 40 and 42 axially spaced along its length. Referring to FIG. 1, upper roller assembly bar 44 is secured by welding in upper aperture 37 of roller support 32. Lower roller assembly bar 46 is positioned in lower aperture 39 of roller support 32 in a fashion that enables it to "float" as will be hereinafter further described. Referring to FIG. 1, each roller 34 engages rail-form slider 12 solely at one of corners 24, 26, 28 and 30. Rollers 34 of pairs of rollers 24 and 26 from upper roller assembly bar 44 are disposed at an angle of 45 degrees relative top surface 16 of rail-form slider 12. Rollers 34 of pairs of rollers 28 and 30 of lower roller assembly bar 46 are disposed at an angle of 45 degrees relative bottom surface 18 of rail-form slider 12. A biasing block 48 is disposed below lower roller assembly bar 46. A plurality of biasing springs 50 are disposed in pockets 52 in biasing block 48. Biasing springs 50 bias lower roller assembly bar 46 into engagement with rail-form slider 12. This results in roller assembly bar 46 moving in and out to accommodate imperfections in rail-form slider 12. Referring to FIG. 2, guide pins 54 extend between lower roller assembly bar 46 and biasing block 48. Guide pins 54 guide movement of lower roller assembly bar 46 relative to biasing block 48.

The use and operation of track and rail-form slider combination 10 will now be described with reference to FIGS. 1 and 2. A plurality of roller supports 32 are mounted by means of mounting hole 43. Rail-form slider 12 is inserted through side openings 35 of a plurality of roller supports 32 into central cavity 33. Pressure is exerted upon lower roller assembly bar 46 to compress springs 50 to permit rail-form slider 12 to be positioned between rollers 34. When in position rollers 34 engage rail-form slider 12 solely at corners 24, 26, 28 and 30. As rail-form slider 12 slides back and forth on rollers 34, springs 50 permit roller assembly bar 46 to move in and out to accommodate any imperfections. Should rail-form slider 12 jump out from between rollers 34, tabs 41 prevent rail-form slider 12 from passing back through side opening 35.

It will be apparent to one skilled in the art that with rollers 34 engaging rail-form slider 12 solely at corners 24, 26, 28, and 30, an accumulation of dirt and debris on top surface 16 of rail-form slider will not adversely affect operation. It will also be apparent to one skilled in the art that rail-form slider is less prone to twisting when a force is exerted that has a lateral component, due to the above described corner engagement. It will also be apparent to one skilled in the art that while 45 degrees is the preferred angle for rollers 34, that rollers 34 are operable within an operative range of between 30 degrees and 60 degrees. It will finally be apparent to one skilled in the art that there are other modifications that may be made to the illustrated embodiment without departing from the spirit and scope of the invention as hereinafter defined in the Claims.

The embodiments of the invention in which an exclusive property or privilege is claimed are defined as follows:

1. A track and rail-form slider combination, comprising:

a. a rail-form slider having a top surface, a bottom surface, sides extending between the top surface and the bottom surface and four corners formed where the top surface meets the sides and the bottom surface meets the sides; and b. a track, including:

i. a plurality of roller supports;

ii. at least four rollers secured to each roller support, each roller engaging the rail-form slider solely at one of the corners.

2. The track and rail-form slider combination as defined in claim 1, wherein the at least four rollers are arranged in pairs, each pair being mounted on a roller assembly bar in a generally "V" shaped configuration.

3. The track and rail-form slider combination as defined in claim 2, wherein each roller assembly bar has two pairs of rollers, each pair of rollers being axially spaced along the roller assembly bar.

4. The track and rail-form slider combination as defined in claim 2, wherein biasing means are disposed between one of the roller assembly bars and the roller supports, the biasing means biasing the roller assembly bar into engagement with the rail-form slider such that the roller assembly bar moves in and out to accommodate imperfections in the rail-form slider.

5. The track and rail-form slider combination as defined in claim 1, wherein each roller is disposed at an angle of between 30 degrees and 60 degrees relative to one of the top surface and the bottom surface of the rail-form slider.

6. The track and rail-form slider combination as defined in claim 5, wherein each roller is disposed at an angle of 45 degrees relative to one of the top surface and the bottom surface of the rail-form slider.

7. A track and rail-form slider combination, comprising:

a. a rail-form slider having a top surface, a bottom surface, sides extending between the top surface and the bottom surface and four corners formed where the top surface meets the sides and the bottom surface meets the sides; and b. a track, including:

i. a plurality of roller supports;

ii. at least four rollers secured to each roller support, each roller engaging the rail-form slider solely at one of the corners with each roller disposed at an angle of between 30 degrees and 60 degrees relative to one of the top surface and the bottom surface of the rail-form slider, the rollers being arranged in pairs, each pair being mounted on a roller assembly bar in a generally "V" shaped configuration; and iii. at least one biasing spring disposed between one of the roller assembly bars and the roller supports, the biasing spring biasing the roller assembly bar into engagement with the rail-form slider such that the roller assembly bar moves in and out to accommodate imperfections in the rail-form slider.

8. The track and rail-form slider combination as defined in claim 7, wherein each roller assembly bar has two pairs of rollers, each pair of rollers being axially spaced along the roller assembly bar.

9. The track and rail-form slider combination as defined in claim 7, wherein each roller is disposed at an angle of 45 degrees relative to one of the top surface and the bottom surface of the rail-form slider.

10. A track and rail-form slider combination, comprising:

a. a rail-form slider having a top surface, a bottom surface, sides extending between the top surface and the bottom surface and four corners formed where the top surface meets the sides and the bottom surface meets the sides; and b. a track, including:

i. a plurality of roller supports;

ii. eight rollers secured to each roller support, each roller engaging the rail-form slider solely at one of the corners with each roller disposed at an angle of 45 degrees relative to one of the top surface and the bottom surface of the rail-form slider, the rollers being arranged in pairs, each pair being mounted on a roller assembly bar in a generally "V" shaped configuration, each roller assembly bar having two pairs of rollers axially spaced along the roller assembly bar; and iii. a biasing block being disposed below the roller assembly bar the rollers of which engage the bottom surface of the rail-form slider, a plurality of biasing springs being disposed in pockets in the biasing block, the biasing springs biasing the roller assembly bar the rollers of which engage the bottom surface of the rail-form slider into engagement with the rail-form slider such that the roller assembly bar moves in and out to accommodate imperfections in the rail-form slider.

* * * * *